United States Patent [19]

Falkner et al.

[11] 4,010,628

[45] Mar. 8, 1977

[54] METHOD AND DEVICE OF MAKING A PROFILED BODY OF AT LEAST ONE BAND OF MATERIALS

[75] Inventors: Raimund Falkner, Roppen, Austria; Heinz Grune, Solingen, Germany

[73] Assignee: Rapena Patent - und Verwaltungs-AG, Stadtle, Liechtenstein

[22] Filed: Jan. 17, 1975

[21] Appl. No.: 542,020

[30] Foreign Application Priority Data

Jan. 22, 1974 Switzerland ..... 810/74
Feb. 13, 1974 Switzerland ..... 2026/74

[52] U.S. Cl. ..... 72/181
[51] Int. Cl.² ..... B21D 5/08
[58] Field of Search ..... 72/181, 176; 29/155 R

[56] References Cited

UNITED STATES PATENTS 3,638,465 2/1972 Lickliter et al. ..... 72/181
3,689,970 9/1972 Falkner ..... 29/155 R
3,841,134 10/1974 Falkner et al. ..... 72/181
3,877,275 4/1975 Attwood ..... 72/181 X

*Primary Examiner*—Milton S. Mehr
*Attorney, Agent, or Firm*—Cushman, Darby & Cushman

[57] ABSTRACT

Improved method and apparatus for of making a profiled body of at least one band of material which is profiled by a series of successive forming steps by means of pairs of rotating forming tools. At least one directrix is determined on the band for some of the forming steps coinciding with a marked longitudinal edge of the body and subdividing the band into a first and second band area. Swinging the first area about the directrix in a first direction and simultaneously swinging the second area about the directrix in opposite direction to said first direction in order to reduce tensile stress in one of the exterior edges of the bands at the cost of increasement of tensile stress in the other exterior edge.

3 Claims, 6 Drawing Figures

METHOD AND DEVICE OF MAKING A PROFILED BODY OF AT LEAST ONE BAND OF MATERIALS

BACKGROUND AND SUMMARY OF THE INVENTION

The invention relates to improvements in method and device for producing a profiled body of at least one band of material which is profiled by a series of successive forming steps by means of pairs of rotating forming tools.

More particularly this invention relates to an improvement of the method described in the U.S. Pat. No. 3,841,134. According to the former method profiled rails and bodies composed thereof are made of at least one metal band by carrying out the following forming steps.

introducing initial undulations into parts of the band to facilitate subsequent profiling of the band by bending it at bending points between rotating pairs of forming rolls:

determining a directrix subdividing the metal band into a first area extending from on exterior edge to said directrix, and a second area extending from the other exterior edge to said directrix, said directrix coinciding with a marked longitudinal edge to be formed into the metal band;

turning at least one of said areas about said directrix so that the exterior edge associated with said area performs a swinging motion while the transverse distance of said associated exterior edge from said directrix is reduced step-by-step throughout the continuous forming process, thereby reducing accrued edge tensile stresses;

increasing said initial undulations of said parts of said band until the enveloping lines of said parts transverse to the metal band become longer than the enveloping of the longitudinal profile contemplated for said parts thereby leaving surplus width whereby no thinning of the band will occur during subsequent upsetting; and transversely upsetting said metal band at said bending points using the surplus width created by increasing said undulations, and bending the metal band with a curvature smaller than the band thickness into sharp-edged profile structures.

The method of the aforesaid patent further comprises exerting a longitudinal tractive force on the metal band by a subsequent pair of rolls as the metal band passes between at least some of the pairs of forming rolls by the roll surfaces of said subsequent pair of rolls being driven at a higher circumferential speed than the corresponding roll surfaces of the preceding pair of rolls. The circumferential speed of said subsequent pair of rolls is higher by at least 0.2 per cent than that of the preceding pair of rolls.

According to the former method a first and second metal band may be formed simultaneously, the second metal band being twisted from its initial position during the continuous forming, profiled, and placed in a predetermined position relative to a profiled rail formed from the first metal band, and indetachably connected to the latter to make a profiled body. Both rails are connected by fold-type connection along their longitudinal borders, the longitudinal borders being forced together and are one longitudinal edge of one rail being bent around the associated longitudinal border of the other rail, the two longitudinal borders thereby becoming indetachably interconnected.

One difficulty arising in the step-by-step forming by means of rotating forming tools resides in the necessary large number of consecutive forming steps in consequence that only a small forming of the band per forming step is admissable due to the tension stresses in the exterior edges which otherwise would cause a undesired formation of tears or permanent elongations in the edges. Roll forming machines adapted for producing complicate profiled bodies normally comprise 20 – 30 subsequent forming stations.

In the aforesaid patent it has already been suggested to reduce the tensile stresses in one edge of the band by determing a directrix on the band and turning the band area between said edge and the directrix about the directrix.

It has been found that this ideal of turning a band area about a directrix may further be developed. Resulting is a new technical prescription for the forming process by which application a considerable reduction of the tensile stresses in one of the edges of a band during its profiling is obtained.

According to the present invention the first forming steps are introducing initial undulations into parts of said band to facilitate profiling of the band during subsequent forming steps. At least one directrix is determined on the band for some of the forming steps, said directrix coinciding with a prominent longitudinal edge of the body and subdividing the band into a first and second band area, the first area extending from one exterior edge of the band to said directrix, the second area extending from the other exterior edge of the band to said directrix. The improvement of the present method comprises: carrying out at least some forming steps by swinging said first area about the directrix in a first direction and simultaneously swinging said second area about the directrix in opposite direction to said first direction towards said first area in order to reduce tensile stresses in one of said exterior edges at the cost of increasement of tensile stresses in the other exterior edge.

Hence one object of the present invention is to provide an improved method for forming profiled bodies which allows a reduction of the number of forming steps.

A further object is to provide improved subsequent forming stations for a forming machine which may replace a greater number of forming stations known in the art.

These objects and the features of the present invention will become more clearly apparent from the subjoined specification and claims when considered in connection with the drawing illustrating some embodiments and when considered in connection with the appended claims.

DETAILED DESCRIPTION OF THE DRAWINGS

Figure 1:
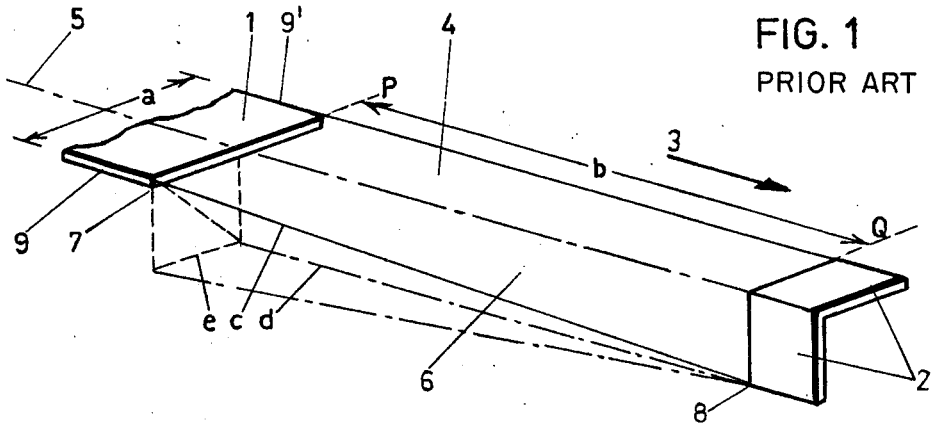
FIG. 1 PRIOR ART
FIG. 1 shows the forming of a flat metal band into a rectangular rail according to the known process to explain the tensile stresses encountered

With reference to FIG. 1 the tensile stresses are discussed unavoidable occuring in the exterior edges of a band, e.g. of metal, during its roll forming by means of rotating roll forming tools. The flat metal band 1 is to be shaped into a rectangular rail 2 having two sides of equal length. During the motion of the band 1 in the direction of the arrow 3 from point P to point Q, the band area 4 located to the left of the directrix 5 as viewed in the direction of motion remains in its initial position. On the other hand the band area 6 located to the right of the directrix 5 as viewed in the direction of motion performs a swinging motion from its initial horizontal position into the vertical position of the downwardly directed side of the angular rail 2. In the process, the point 7 of the right-hand exterior edge 9 of the band 1 moves along line *c* to the point 8 of the angular rail 2. Compared to the distance *b* between the points P and Q the line *c* is longer, which however means that the right-hand exterior edge 9 of the band 1 must dilate in the longitudinal direction and comes under the action of a corresponding tensile stress.

The difference in length along line *c* between the points 7 and 8 on the one hand and the distance *b* between the points P and Q on the other can be estimated since the line *c* forms the hypotenuse of the right-angled triangle with the legs *d* and *e*. The leg *e* in its turn forms the hypotenuse of the indicated right-angled triangle with the two legs ½*a* if *a* designates the width of the band 1. By way of example, in shaping a band 1 of $a = 10$ cm width, a difference in length beteen the lines *c* and *b* would, depending on the distance *b* between the points P and Q, obtain as per the Table here following:

| Distance b | Elongation b – c |
|---|---|
| 50 cm | 4.95 mm or approx. 1% |
| 100 cm | 2.49 mm or approx. 0.25% |
| 200 cm | 1.25 mm or approx. 0.07% |
| 300 cm | 0.84 mm or approx. 0.03% |

It is obvious that e.g. an aluminium band of 10 cm width can not by a any means be stretched by 1% or 5 mm over a length of 50 cm without causing cracks or permanent deformations. Accordingly, in shaping as per the diagrammatic FIG. 1, the distance *b* between the points P and Q must be increased until the elongation of the exterior edge 9 of the right-hand band area 6 assumes a value which is within the range of elasticity of the band material. By way of example, with a distance of the points P and Q of 300 cm, the elongation of approximately 0.03% then necessary would be admissible with a suitable band material. Accordingly, a shaping apparatus for the production of the angular rail 2 as per FIG. 1 would have to be of an appropriate length and have a corresponding number of forming stations with a pair of rolls each between the points P and Q.

Figure 2:
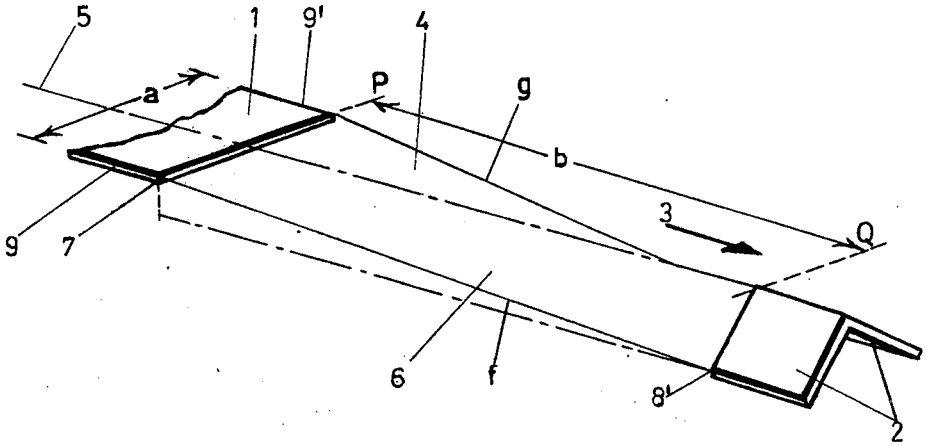
FIG. 2 shows the forming of a same metal band according to the present invention to explain the reduction of the tensile stresses

According to the teachings of the method of the present invention, however, the shaping of the metal band 1 into an angular rail 2 shown in FIG. 1 can be improved in that the band area 6 located to the right of the directrix 5 is swung about the assumed directrix 5 in one direction in shaping the metal band 1 from the point P to the point Q, as indicated diagrammatically in FIG. 2, while the band area 4 located to the left of the directrix 5 is at the same time moved towards the band area 6 in the opposite direction of rotation. The point 7 of the exterior edge 9 of the right-hand area 6 now moves along the line f to the point 8'. and this line *f* performs a smaller difference in length to the distance *b* between the points P and Q than the line *c* shown in FIG. 1 because the band area 6 of the angular profile 2 has performed swinging motion not by 90° but by only 45°. The reduction of the difference in length is probably about 50%, which results in a corresponding reduction of the tensile stresses along the exterior edge 9. Compared to the shaping according to FIG. 1, the left-hand band area 4 is now naturally no longer left in its original position but undergoes a swinging motion in the opposite direction of rotation relative to the swinging motion of the right-hand band area 6 so that the exterior edge 11 extends along the line g in FIG. 2. The exterior edge 9' is thus similarly elongated as the exterior edge 9 of the right-hand band area 6 and a corresponding tensile stress is caused there.

According to the present method, the tensile stress occasioned in the exterior edge of the band area involved, which performs a swinging motion during a predetermined forming step, is reduced in that part of the tensile stress is now operative on the exterior edge of the other band area which was entirely unstressed in previous processes. This reduction of the maximum tensile stress that occurs by division between the exterior edges of the two band areas makes it possible, if a band made of a material having certain mechanical properties is employed, to reduce the distance between the points P and Q and thus to reduce the number of required forming steps.

In the continuous production of profiled bodies made of at least one band of material it is of advantage to apply the technical instruction according to the present method in each of the consecutive forming steps. As experience has shown, this enables a decisive reduction of the total required number of successive forming steps to be achieved.

Figures 3, 4:
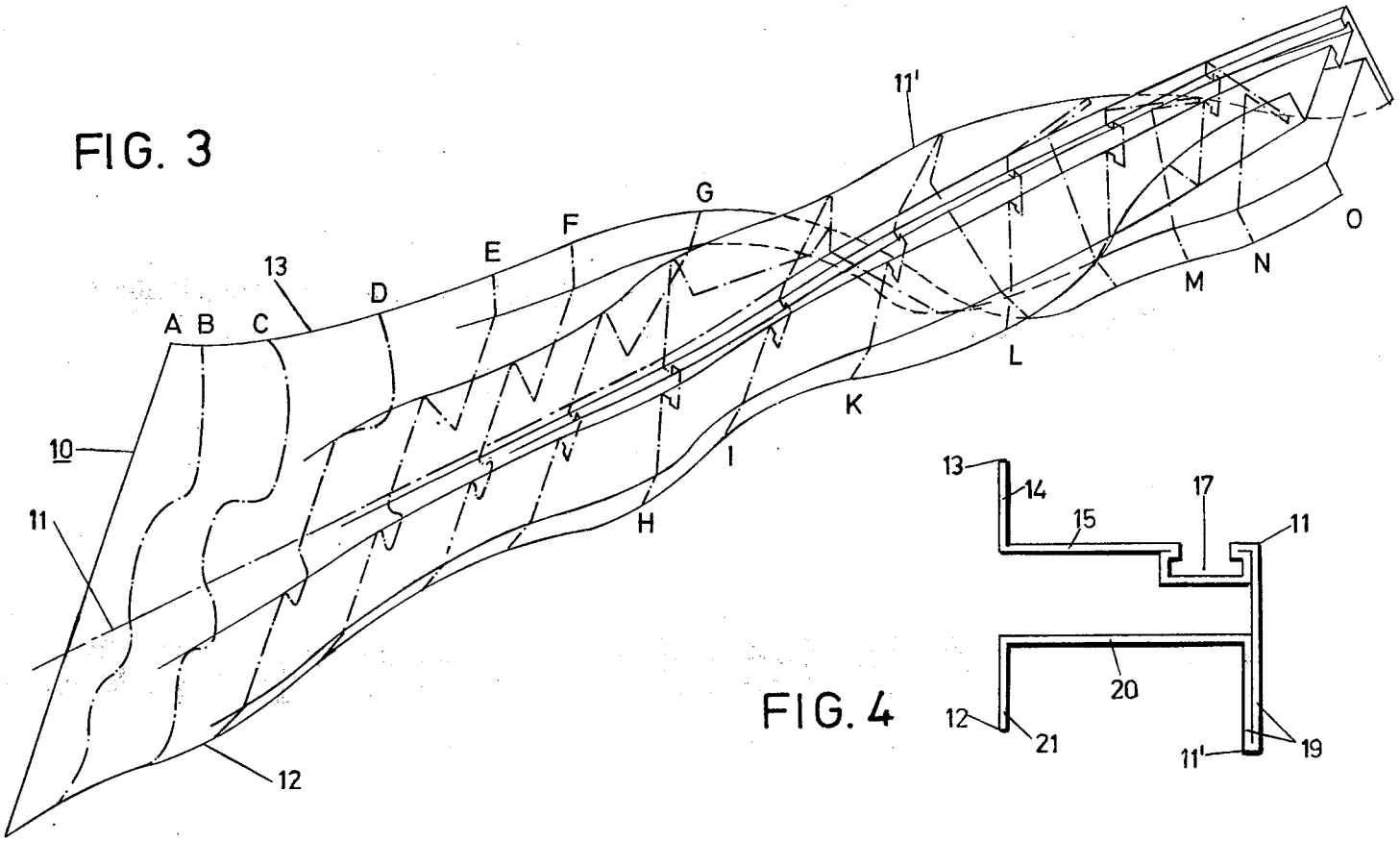
FIG. 3 is a schematic view of the gradual profile according to the present invention of a flat metal band illustrating consecutive forming steps A, B, . . . O.
FIG. 4 is a cross-section view of a profiled rail made according to FIG. 3.

FIG. 3 illustrates the application of the technical prescription of the present method for the profiling of a metal band 10 into the profiled rail according to FIG. 4. The profiled rail according to FIG. 4 is shaped with the two side walls 15 and 20, the double-walled portion 19, the longitudinal groove 17 provided in the side wall 15, and the longitudinal borders 14 and 21 formed at the side walls 15 and 20, respectively.

The continuous processing of the metal band 10 into the profiled rail is illustrated in connection with the dot-dashed cross-sectional profile structures A, B, C . . . M, N, O consecutively processed. The forming steps are, however, solely described in the viewpoint of the application of the technical prescription of the present method. A detailed description of the undulations, the profiling of the grooves and the upsetting processes will be found in the aforesaid patent.

A directrix 11 is first determined on the band 10 in its horizontal initial position A which coincides with a particularly prominent longitudinal edge of the completed profiled rail. The directrix 11 subdivides the band 10 into a first band area 11 – 12 extending between the directrix 11 and the exterior edge 12, and into a second band area 11 – 13 extending between the directrix 11 and the other exterior edge 13. According to the principles discussed in the aforesaid patent undulations are introduced into the band during the first forming steps and increased until the enveloping lines of the undulated parts of the band transverse to the band become longer than the enveloping lines of the profiled rail contemplated for said parts, thereby leaving surplus width.

During the swinging motion of the second band area 11 – 13 into the final position O considerable tensile stresses are effected in the exterior edge 13 which normally would damage the edge 13. In application of the technical prescription of the present method, however, a transformation of part of the tensile stress into the other unstressed exterior edge 12 is achieved. FIG. 3 illustrates that while processing the profile structures D through I an edge 11' is performed which serves for some forming steps as directrix. After running the profile structure G the band area 11' – 13 between the directrix 11' and the exterior edge 13 performs a strong swinging motion downwards into the profile structure H. In order to reduce the involved tensile stress effected in the exterior edge 13 — and according to the present technical prescription — the band area 11' – 12 between the directrix 11' and the exterior edge 12 is simultaneously swung about the directrix 11' towards the band area 11' – 13. The band area 11' – 12 therefore shows in the profile structure H a torsioned position with respect to its position in the profile G. During the next forming step the band area 11' – 12 is swung back in its initial position. FIG. 3 shows that the exterior edge 12 has been elongated in the range between the profile structures G through I under the action of a tensile stress. It has been shown in the foregoing embodiment that the amount of this tensile stress is approximately equivalent to the amount by which the tensile stress in the strained exterior edge 13 has been reduced when processing the band from the profile structure G into the profile H.

The forming steps for processing the band 10 from the profile structure K into the profile M perform a swinging motion of the second band area 11 – 13 about the directrix 11 which effects a strong tensile stress in the exterior edge 13 and the edge 11'. In order to reduce this tensile stress the first band area 11 – 12 is simultaneously swung in the opposite direction towards the second area 11 – 13. This simultaneous swinging of the first and second band areas in opposite directions towards one another is performed particularly during processing the profiles K through L. Resulting is an arched exterior edge 12 in the range between the profiles K through M, the elongation of which is again approximately corresponding to the amount of tensile stress transformed from the stressed edge 13.

In the embodiments the method is described for the profiling of a metal band although obviously a band of any suitable material may be profiled according to the invention. The method is preferably used for the production of profiled bodies specified in the aforesaid patent. For example profiled hollow bodies are produceable consisting of one profiled band of which the both exterior edges are joined along a seam connection. The method of the present invention is further practicable for the simultaneous processing of two bands of material, which are first profiled and then assembled to a profiled body, and which may consist of different materials.

Figure 5:
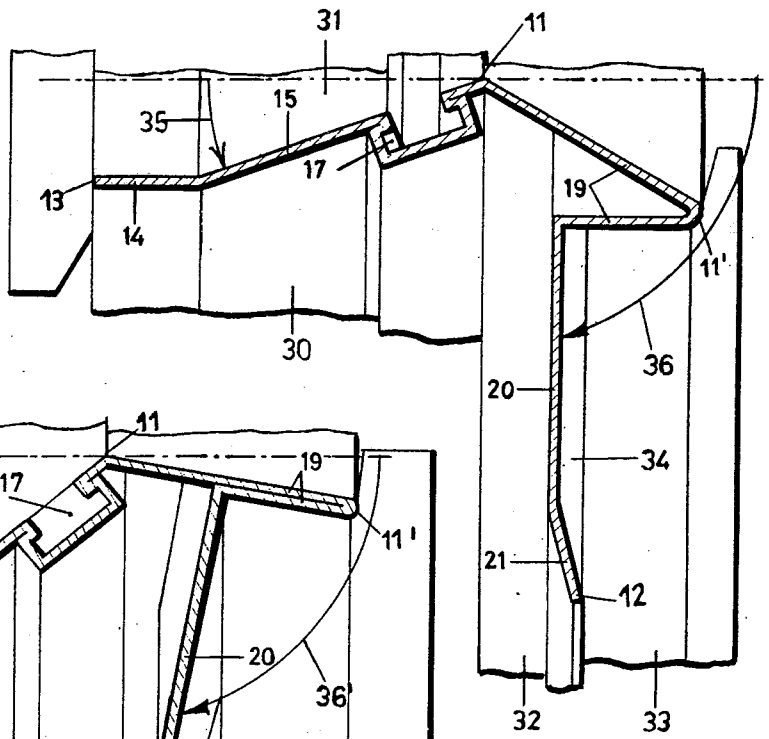
FIGS. 5 and 6 are cross-section views of two consecutive forming stations of a forming machine performing the forming steps K and L of FIG. 3.
Figure 6:
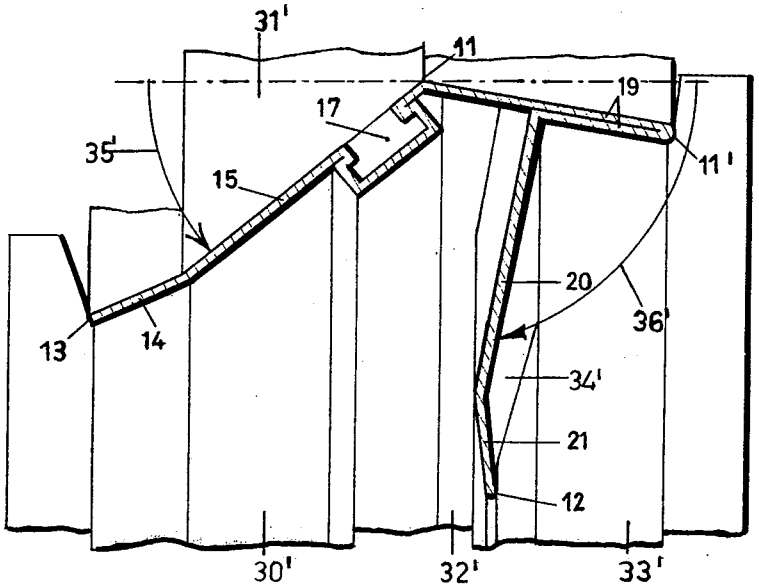

The FIGS. 5 and 6 show embodiments of two successive forming stations of a roll forming machine for processing the band 10 of FIG. 3 according to the technical prescription of the method of the present invention. The forming stations comprise rotating roll forming tools of which some are identified by the reference numerals 30 through 33 and 30' through 33', respectively. A gap is provided between cooperating pairs of forming tools. Cooperating pairs are i.e., in FIG. 5 the forming tools 30, 31 and 32, 33, and accordingly the pairs 30', 31' and 32', 33' in FIG. 6. The band 10 is processed through the gaps of cooperating forming tools and the reference numerals of its band portions correspond to the contemplated profiled rail of FIG. 4. The pairs of forming tools are so aligned that the directrix 11 runs in parallel with the direction of travel of the metal band. In preceding forming steps, the first and second band areas 11 – 12 and 11 – 13, respectively, on either side of the directrix 11 have been processed into the profile structure K in FIG. 3. In order to reduce the tensile stress in the exterior edge 13 of the second band section, the first band area 11 – 12 has already been swung about the angle 35. In the succeeding forming station of FIG. 6 the gaps for the first band area 11 – 12 are designed in such a manner that their new angle 35' is greater than their preceding angle 35. The band portion 20, 21 of the second band area 11 – 13 to be swung about the directrix 11 extends in the gap 34 between the side walls of the forming tools 32, 33 and has already been rotated by the angle 36. The gaps in the forming station of FIG. 6 for performing the double walled portion 19 cause a rotation of the portion 19 in the upward direction so that the band portion 20, 21 performs a swinging movement about the greater angle 36' within the gap 34'. The gaps in successive pairs of tools are thus so designed that an increase in the inclination of the first and second band areas relative to the initial position of the band is obtained per forming station.

Generally speaking a roll forming machine which performs the method of the present invention must comprise at least some consecutive forming stations in which the cooperating forming tools are aligned along a directrix which runs in direction of travel. This directrix needs however not be identically located in all pairs of tools. The individual pairs of tools are so designed in the usual manner that a gap is formed between cooperating tools and which gap is designed for the passage of the band. On either side of said directrix extends one gap or a series of consecutive gaps. The gaps on either side of the directrix are adapted for forming the first and second band area. In at least one forming station the gaps on either side of the directrix must be designed in such a manner relatively to the corresponding gaps of the preceding station, that at least band portions of the first and second band areas passing said gaps of said forming station perform a swinging motion towards another. This swinging motion in the direction of travel is advantageously performed in many successive forming stations in order to reduce the number of the forming steps to the extent possible.

However, there may occur cases where the contemplated shaping of the band does not render the application of the said rule necessary in all forming stations. The increase of the two said angles ensures that at least the two outer portions move towards one another during the passage of the band through the gaps, which results in a division of the total tensile stresses operative on the exterior edges due to profiling.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and devices.

We claim:

1. A method of making a profiled body from a band of material having two exterior edges, comprising the steps of introducing initial undulations into parts of said band to facilitate profiling of the band during subsequent forming steps, determining at least one directrix on the band, said directrix coinciding with a prominent longitudinal edge of the body to be formed, and said directrix dividing the band into first and second band areas, the first band area extending from one exterior edge of the band to said directrix, and the second area extending from the other exterior edge of the band to said directrix, evening out and minimizing the tensile stresses in said exterior edges and reducing the number of rolls necessary for further forming operation on said band by swinging said first area about said directrix in a first direction and simultaneously swinging said second area about said directrix in a direction opposite to said first direction and towards said first area, and carrying out additional forming steps to form said profiled body.

2. A method as recited in claim 1 wherein said step of carrying out additional forming steps includes the step of joining said exterior edges to form the profiled body.

3. Apparatus for making a profiled body from a band of material having two exterior edges, comprising means for introducing initial undulations into parts of said band to facilitate profiling of the band during subsequent forming steps, means for evening out and minimizing the tensile stresses in said band exterior edges during profiling and for reducing the number of rolls necessary for further forming operations on said band by swinging a first area of said band about a directrix in a first direction and simultaneously swinging a second area of said band about said directrix in a direction opposite to said first direction and towards said first area, said directrix coinciding with a prominent longitudinal edge of the body to be formed and dividing said band into first and second band areas, the first band area extending from one exterior edge of the band to said directrix, and the second band area extending from the other exterior edge of the band to said directrix, and means for carrying out further profiling of said band to form the profiled body.

* * * * *